US005661880A

United States Patent [19]

Schippers et al.

[11] Patent Number: 5,661,880

[45] Date of Patent: Sep. 2, 1997

[54] METHOD AND APPARATUS FOR PRODUCING A MULTIFILAMENT YARN BY A SPIN-DRAW PROCESS

[75] Inventors: Heinz Schippers; Erich Lenk, both of Remscheid, Germany

[73] Assignee: Barmag AG, Remscheid, Germany

[21] Appl. No.: 598,839

[22] Filed: Feb. 9, 1996

[30] Foreign Application Priority Data

Feb. 10, 1995 [DE] Germany ..... 195 04 422.3

[51] Int. Cl.[6] ..... D01D 4/02; D01D 5/08; D01D 10/02

[52] U.S. Cl. ..... 28/240; 28/245; 264/290.5; 264/210.8; 425/66

[58] Field of Search ..... 28/240, 241, 243, 28/245; 264/290.5, 288.8, 210.8, 291; 425/66

[56] References Cited

U.S. PATENT DOCUMENTS

| | | | |
|---|---|---|---|
| 3,771,307 | 11/1973 | Petrille . | |
| 3,772,872 | 11/1973 | Piazza et al. . | |
| 4,185,064 | 1/1980 | Schippers | 264/210.2 |
| 4,235,000 | 11/1980 | Nikkel | 28/241 |
| 4,731,217 | 3/1988 | Gerhartz et al. . | |
| 4,774,042 | 9/1988 | Schippers | 264/210.8 |
| 4,863,664 | 9/1989 | Burton | 264/210.8 |
| 5,408,730 | 4/1995 | Yamamoto | 28/240 |

FOREIGN PATENT DOCUMENTS

| | | |
|---|---|---|
| 0 089 912 | 9/1983 | European Pat. Off. . |
| 19 05 507 | 8/1970 | Germany . |
| 22 54 998 | 7/1975 | Germany . |
| 22 41 718 | 12/1976 | Germany . |
| 35 28 306 | 2/1986 | Germany . |
| 1 262 813 | 2/1972 | United Kingdom . |

*Primary Examiner*—Andy Falik

*Attorney, Agent, or Firm*—Bell, Seltzer, Park & Gibson, P.A.

[57] ABSTRACT

A method and apparatus for producing a multifilament yarn by a melt spinning-draw process, and which includes applying additional heat to the melt in the region of the spinneret. The relationship between the withdrawal speed and draw ratio may be changed, and with an adaptation of other process parameters, it is possible to increase productivity. The process may be applied to continuous and discontinuous processes.

16 Claims, 5 Drawing Sheets

ELONGATION AT BREAK [%] AS A FUNCTION OF THE WITHDRAWAL SPEED $\left(\frac{|Br-|}{|} \cdot 100\right)$

YARN DENIER (DENIER PER FILAMENT)

| WITHDRAWAL SPEED (m/min) | 0.3 | 0.5 | 1 | 2 | 4 |
|---|---|---|---|---|---|
| 2000 | 132% | 155% | | | |
| 2500 | 103% | 122% | 142% | 153% | |
| 3000 | 81% | 96% | 114% | 121% | 138% |
| 3500 | 70% | 78% | 91% | 97% | 110% |
| 4000 | 63% | 69% | 76% | 80% | 90% |
| 4500 | 56% | 61% | 67% | 70% | 76% |
| 5000 | 50% | 54% | 60% | 63% | 67% |
| 5500 | 45% | 48% | 52% | 56% | 59% |
| 6000 | 40% | 43% | 48% | 49% | 52% |

TABLE I.

METHOD AND APPARATUS FOR PRODUCING A MULTIFILAMENT YARN BY A SPIN-DRAW PROCESS

BACKGROUND OF THE INVENTION

The present invention relates to a method and apparatus for producing a multifilament yarn from a heated thermoplastic melt.

DE-B 22 41 718 (Du Pont) and U.S. Pat. Nos. 3,771,307 and 3,772,872 disclose a method and apparatus of the described type which is characterized by the steps of melt spinning a yarn at a high withdrawal speed and then drawing the yarn, the drawing occurring along with a false twist texturing treatment.

It has been found that there exists a physical dependence between the withdrawal speed and the draw ratio that can still be realized thereafter. This interdependence occurs as a result of a partial orientation of the molecule chains that is realized by the high withdrawal speed which is in this instance more than 2,000 meters per minute. As a consequence, the elongation at break of the thus partially oriented yarn (POY) and, thus, likewise its subsequent stretchability are reduced. For a polyester yarn (polyethylene terephthalate, and others), and for a polyamide yarn (nylon 6 and nylon 6.6), the physical dependence may be noted essentially from the diagram of German Patent 22 54 998. "Normal withdrawal speed" and/or "normal draw ratio", as used hereafter, are meant to be a draw ratio, which maintains the relationships in accordance with this diagram, i.e., the partially oriented yarn is spun in conventional manner and not in accordance with the teaching of this invention.

Together with the total denier of the yarn that is to be produced, this physical dependence causes a limitation of productivity. The productivity again can be measured by the delivery or flow rate of the melt, i.e., the weight of the melt per unit time, expressed for example as grams per minute.

In a continuous spin-draw and takeup process, the increase in the withdrawal speed does not result in a corresponding increase in productivity, since as the withdrawal speed increases, the stretchability or draw ratio decreases and, consequently, the takeup speed changes only little or not at all.

In such a continuous spin-draw and takeup process, the yarn advances immediately after spinning to a draw zone, and is wound after passing through the draw zone.

In a discontinuous production process, a takeup occurs after spinning. The produced package is then supplied to a draw machine, and wound again after passing through the draw zone. In this process, the rate of flow, at which the melt is discharged, results from the total denier that must be reached at a given withdrawal speed and draw ratio. Due to the physical relationships, the conventional production process does not permit a significant increase in productivity to be realized for a yarn by melt spinning a partially oriented yarn and its subsequent drawing (see, treatise "Spinnstrecken-Schnellspinnen-Strecktexturieren" in International Textile Bulletin ITB, 1973, p. 373).

It is accordingly an object of the present invention to provide a method and apparatus for the production of a multifilament yarn which permits the production rate to be increased.

SUMMARY OF THE INVENTION

The above and other objects and advantages of the present invention are achieved by the provision of a method and apparatus which includes the steps of extruding the heated melt through a spinneret at a predetermined weight flow rate so as to produce a plurality of advancing filaments, and including applying additional heat to the melt in the spinneret and/or immediately upon its exit from the spinneret. The advancing filaments are then gathered to form an advancing yarn, and the advancing yarn is withdrawn from the spinneret at a speed of at least about 2000 m/min so as to at least partially orient the molecules of the yarn. Thereafter, the advancing yarn is drawn between two feed rolls so as to impart a predetermined draw ratio, and finally, the advancing yarn is wound into a yarn package.

As important features of the present invention, the withdrawing step and the drawing step include adapting the withdrawal speed and/or the draw ratio to the changed physical relationship between the withdrawal speed and draw ratio resulting from the amount of heat applied in the step of applying additional heat to the melt. Also, the extruding step includes adapting the weight flow rate of the melt to the adapted withdrawal speed and/or the adapted draw ratio such that a predetermined total denier is attained.

In one embodiment, the process is a continuous production process. In such a case, the desired total denier of the yarn to be produced and the desired flow rate of the melt result in the takeup speed of the yarn, which corresponds substantially to the final speed in the draw zone. By inputting a desired draw ratio, the withdrawal speed of the yarn from the spinneret is obtained, or vice versa, by inputting a desired withdrawal speed, the draw ratio is obtained in both cases in accordance with the predetermined physical relationship. Only the measure as provided by the present invention results in an increase in productivity to a noteworthy extent, since it allows to break the described physical relationship between withdrawal speed and draw ratio.

A second embodiment of the invention involves a discontinuous production process, which includes the steps of spinning and winding the yarn in the spinning phase, and drawing and winding it again in the subsequent drawing phase. In this embodiment, the following alternatives are possible:

There are processes, which require leaving the draw ratio within certain limits. This applies in particular to draw texturing. In the draw texturing process, not only the properties of the end product, but also the reliability of the texturing process are dependent on the selection of a suitable draw ratio. Otherwise, the multifilament yarn will not withstand the stresses in the false twist texturing process. Individual filaments will break. An unsuitable draw ratio means not only an inferior quality of the produced yarn, but also involves the risk of interrupting the process by filament breakages.

In other production processes, critical conditions are to be expected within the spinning process. To this end, the withdrawal speed is predetermined within suitable limits. The withdrawal speed must be selected such that the partially oriented yarn can be produced safely and without filament breakages. This is especially necessary for high-tenacity yarns or yarns with a large number of filaments, which involve, due to a high air friction, the risk of filament breakages, and the thereby caused impairment of the yarn quality or interruption of the spinning process.

With the first embodiment of the invention, the increase in productivity results in the spinning phase.

In both alternatives noted above, the second embodiment permits an increase in productivity by increasing the flow rate of the melt, in the one alternative a yarn being wound in the spinning phase without raising the takeup speed, but with an increased denier of the partially oriented yarn, and the yarn being drawn in the drawing phase at an increased draw ratio. Thus, in the drawing phase, the produced yarn length is likewise increased, while the total denier remains unchanged. In the other alternative, the increase in the flow rate of the melt results in an increase of the takeup speed and, thus, in an increase in productivity, in the spinning phase. The subsequent drawing occurs in the usual manner.

An important feature of the invention is the fact that the molten state of the melt strands emerging from the nozzle holes of the spinneret and becoming subsequently individual filaments is still maintained over a length, even though the length is short. It is possible that this may similarly occur where relatively large diameters are used for the nozzle holes in the spinneret. In accordance with the invention, however, the increase in productivity may be achieved in operationally reliable manner only by a supply of heat.

The heat may be supplied to the melt upon its exit from the spinneret by directing a current of heated air or gas against the melt strands, with the current being directed perpendicularly to the melt strands or transversely thereto with a component directed toward the underside of the spinneret. This embodiment has the advantage that the actual spinning apparatus need not be modified, and that the heating zone may be extended to any desired length and according to requirements.

However, in this process undesirable evaporations of monomers and oligomers may develop, which deposit on the underside of the spinneret and adversely affect the reliability of the process.

To avoid this disadvantage, the heat may be supplied by heating the spinneret, to an extent to at least compensate for the heat loss of the spinneret normally incurred as the result of the usual cooling air flow, radiation, etc. This procedure prevents primarily the molecules from becoming oriented in the spinneret. In this connection, it should be noted that the partial orientation of the yarn or the yarn molecules is also caused largely by the flow conditions in the narrow nozzle holes of the spinneret. The heating of the spinneret prevents this flow orientation from solidifying and leading to a corresponding partial orientation.

It is believed that the spinneret should be heated by more than 5° C., preferably 5° to 30° C. In the tests, heating was at about 10° C.

DE-OS 19 05 507 teaches that a spinneret may be heated for compensating for the heat losses in a conventional spinning process at low withdrawal speeds and without partial orientation of the yarn. In the present invention, the spinneret may be heated, for example, by providing resistance heating wires in or on the spinneret. The resistance heating wires may then be operated at a desired temperature.

The heat may also be supplied to the spinneret by infrared radiation, by positioning an annular metallic member below the spinneret, and heating the member to a temperature sufficient to emit infrared radiation. This has the advantage that the spinning apparatus need not be modified to a significant extent. Moreover, it prevents contaminations, oligomers, and monomers from depositing on the spinneret, and it ensures that the spinneret is evenly heated over its entire surface.

The radiation heater may be mounted by a hinge so as to permit it to be selectively opened and thereby provide access to the spinneret for cleaning and for removing deposits by scraping.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
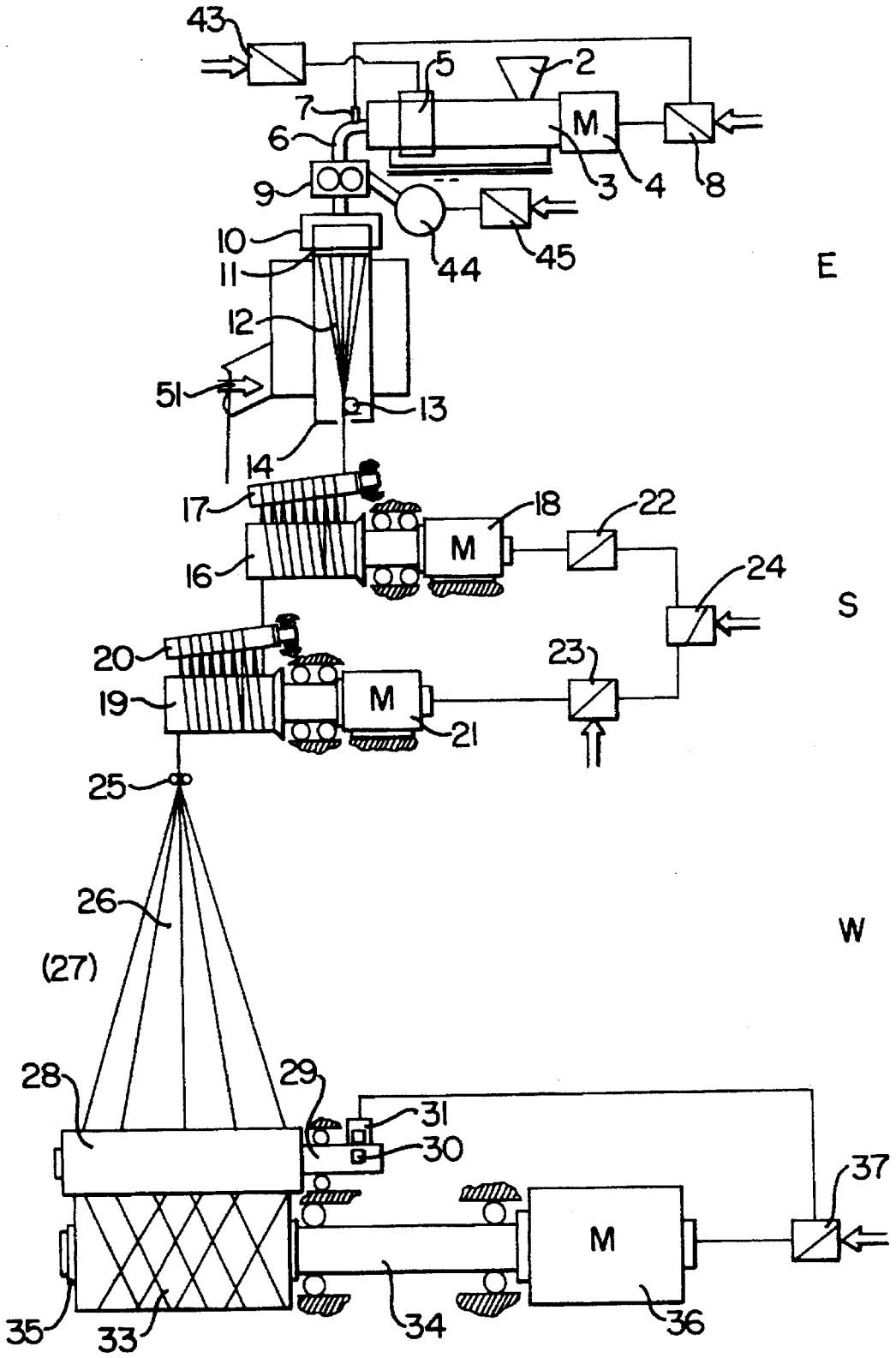
FIG. 1 is a schematic view of a continuous spin and draw process for producing a flat yarn.

The processes described below are equally suitable for spinning yarns of polyester or polyamide. A polyester may be in particular polyethylene terephthalate. Used as polyamides are in particular nylon 6 (Perlon™) and nylon 6.6. It should be expressly remarked that the process data indicated below are for polyester. They apply accordingly to polyamide yarns with deviations that are to be established by tests.

Described below is the spinning process. This description of the spinning process applies to both the embodiment of FIG. 1 and the embodiment of FIG. 2, except deviations as will be expressly identified.

A yarn 1 is spun from a thermoplastic material. The thermoplastic material is supplied through a hopper 2 to an extruder 3. The extruder 3 is driven by a motor 4, which is controlled by a control unit 8. In the extruder, the thermoplastic material is melted. The work of deformation, which is applied by the extruder, assists in the melting process on the one hand. In addition, a heater 5 in the form of a resistance heater is provided, which is controlled by a heating control unit 43. Through a melt line, the melt reaches a gear pump 9, which is controlled by a pump motor 44. The melt pressure before the pump is detected by a pressure sensor 7, and maintained constant by feeding the pressure signal back to motor control unit 8.

The pump motor is controlled by a control unit 45 such as to permit a very fine adjustment of the pump speed. The pump 9 transports the melt flow to a heated spin box 10, the underside of which mounts a spinneret 11 accommodated in a spin pack 53 (note FIG. 4). From spinneret 11, the melt emerges in the form of fine filament strands 12. The filament strands advance through a cooling shaft 14. In the cooling shaft 14, an air current 15 is directed transversely or radially to the web of filaments, thereby cooling the filaments.

At the outlet of cooling shaft 14, the web of filaments is combined by an applicator roll 13 to a yarn 1, thereby receiving a liquid spin finish. The yarn is withdrawn from cooling shaft 14 and from spinneret 11 by a godet 16. The yarn loops several times about the godet. To this end, a guide roll 17 is used, which is axially inclined relative to godet 16 The guide roll 17 is freely rotatable. The godet 16 is driven at a preadjustable speed by a motor 18 and a frequency changer 22. This withdrawal speed is by a multiple higher than the natural exit speed of the filaments from spinneret 11.

The adjustment of the input frequency of frequency changer 22 allows to adjust the rotational speed of godet 16, thereby determining the withdrawal speed of yarn 1 from spinneret 11.

Figure 2:
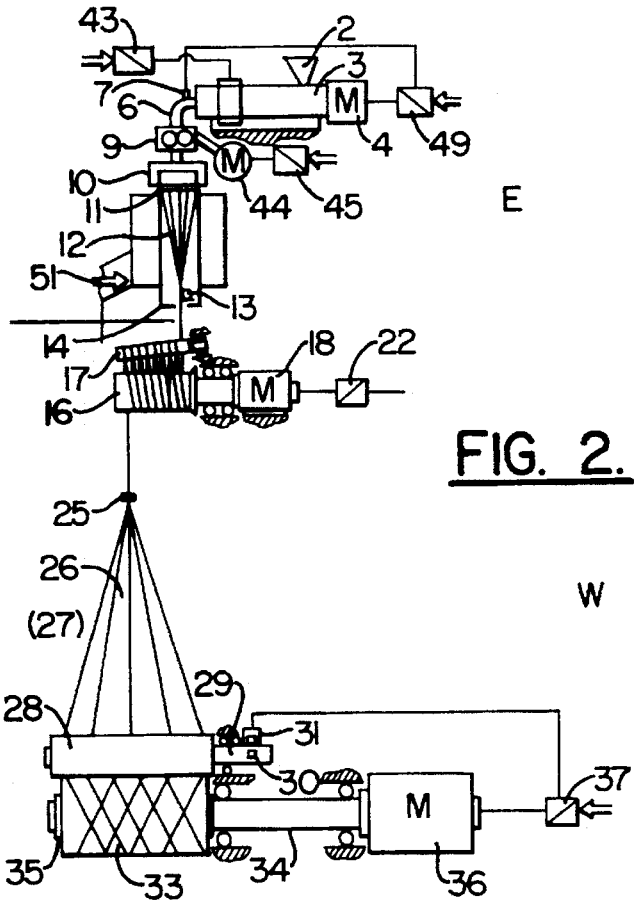
FIGS. 2 and 3 are schematic views of a two-step process for spinning a partially oriented, flat yarn and for subsequently draw texturing the partially oriented yarn in a second process step.

Up to this point, the description applies in like manner to the spinning process shown in FIG. 2. For the drawing step in the schematic illustration of FIG. 1, the following description applies:

Downstream of godet 16 is a draw roll or godet 19 with a further guide roll 20. With respect to their arrangement, both correspond to that of godet 16 with guide roll 17. Draw roll 19 is driven by a motor 21 with a frequency changer 23. The input frequency of frequency changers 22 and 23 is evenly preset by a controllable frequency changer 24. In this manner, it is possible to individually adjust on frequency changers 22 and 23 the speed of godet 16 and draw roll 19 respectively, whereas the speed level of godet 16 and draw roll 19 is adjusted collectively on frequency changer 24.

From draw roll 19, the yarn 1 advances to a so-called "apex yarn guide" 25, and thence into a traversing triangle 26.

The following description will apply in like manner to the takeup step in the process of FIG. 1 and in the process of FIG. 2. In both Figures, the yarn traversing mechanism is not shown.

The traversing mechanism may be, for example, a cross-spiralled roll with a yarn guide traversing therein and reciprocating the yarn over the length of a package 33. In so doing, the yarn loops about a contact roll 28 downstream of yarn traversing mechanism 27. The contact roll 28 rests against the surface of package 33. It is used to measure the surface speed of package 33. The package 33 is wound on a tube 35, which is clamped on a winding spindle 34. The spindle 34 is driven by a motor 36 and a spindle control unit 37 such that the surface speed of package 33 remains constant. To this end and for use as a control variable, the speed of freely rotatable contact roll 28 is sensed and corrected by means of a ferromagnetic insert 30 and a magnetic pulse transmitter 31.

In the process of FIG. 1, the adjustment of spindle control unit 37 allows to adapt the takeup speed to the circumferential speed of draw roll 19.

In the embodiment of FIG. 2, the yarn advancing from godet 16 moves on directly to apex yarn guide 25 and into the traversing triangle 26. In this embodiment, an adaptation occurs in corresponding manner between the circumferential speed of package 33 and the withdrawal speed, which is predetermined by godet 16.

In both cases, the circumferential speed of package 33, which is sensed and corrected by contact roll 28, is slightly lower than the circumferential speed of preceding godets 16 or 19, since the takeup speed of the yarn results as a geometric sum from the circumferential speed of package 33 and the traversing speed of yarn traversing mechanism 27 which is not shown.

Figure 3:
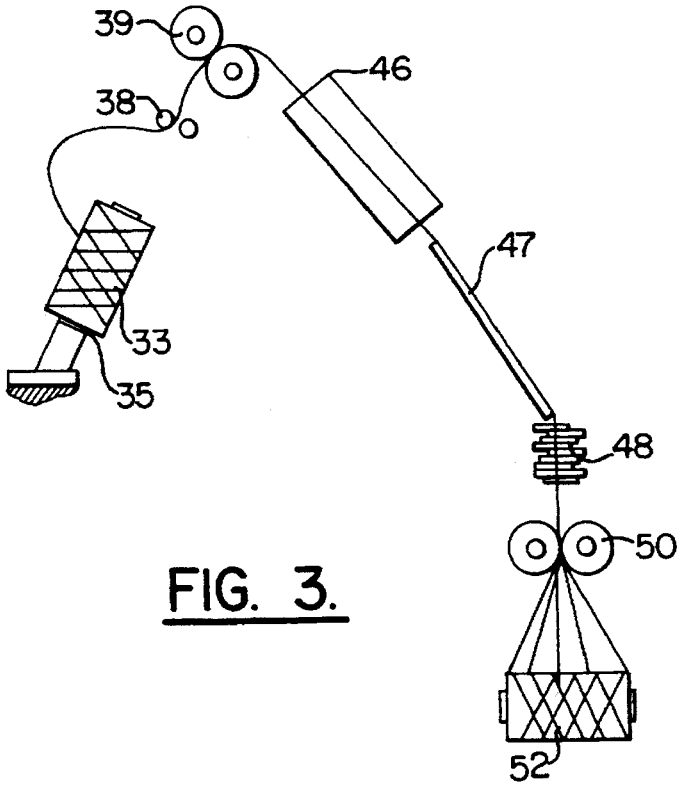

FIG. 3 is a schematic illustration of a draw-texturing process. The package 33 with a partially oriented yarn, which was produced by the spin process of FIG. 2, is supplied to a draw-texturing machine. Yarn guides 38 advance the partially oriented yarn to a first feed system 39, from where the yarn passes through a heater 46, a cooling rail 47, a friction false twist unit 48, to a second feed system 50, so as to be subsequently wound to a package 52. The feed systems 39 and 50 are driven at different speeds. As a result, the necessary drawing occurs in the false twist zone between these feed systems along with a heating and a false twist texturing.

In the following, the processes of FIGS. 1 and 2 or 3 are described in more detail.

Referring now to FIG. 1, a continuous spin-draw process is shown. In this process, the total denier results from the takeup speed and the flow rate of the melt.

For example, a yarn having a total denier of 2 denier per filament is to be produced. The withdrawal speed is to be 3000 m/min. Under normal circumstances, i.e. without heating the spinneret, this results in an elongation at break of the produced yarn of 120%. In other words, this means that the withdrawn, partially oriented yarn can be drawn to 220% of its length before breaking. As a consequence thereof, the draw ratio is about two thirds of this value, namely, for example 1:1.6.

This results in a withdrawal speed of 4800 m/min. (3000 m/min×1.6=4800 m/min). With a filament having, as aforesaid, a weight per unit length measure of 2 denier per filament and a number of 72 filaments, the result is a total denier of 150. From this, the flow rate of the melt for each spinning position is 150 g/9000 m×4800 m/min=80 g/min. Assuming now that the withdrawal speed for the production of the same yarn is increased to 4000 m/min, the elongation at break will be 80%, i.e., the yarn can be drawn to 180% of its length before breaking. When a draw ratio having again an approximate range of two thirds is selected, the draw ratio will be 1:1.2. This means that the withdrawal speed is not increased.

It is obvious that the flow rate of the melt discharged from the pump cannot be increased in the production of the same total denier. Therefore, the increase in production or productivity is irrelevant.

Figure 4:
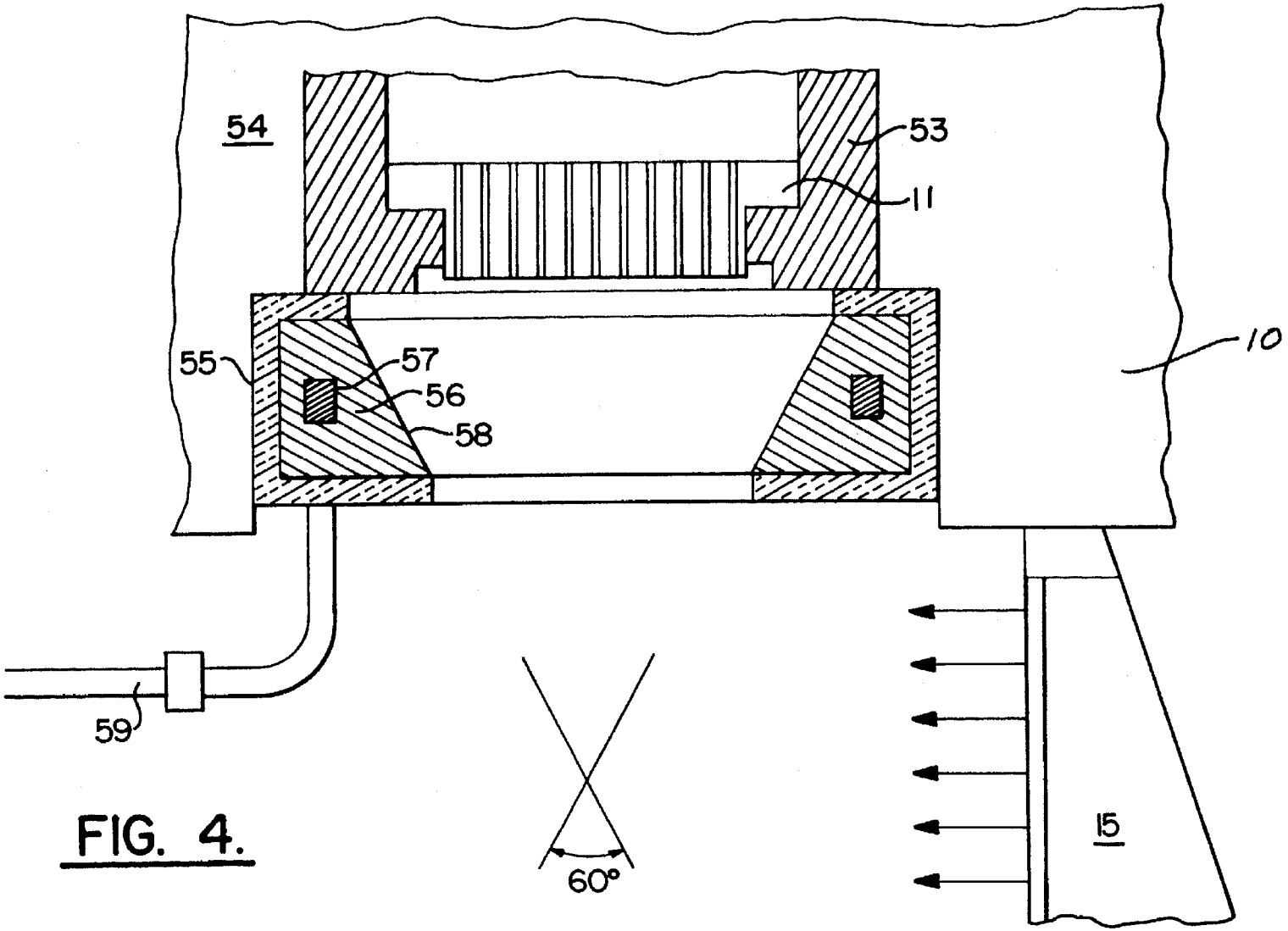
FIG. 4 is a sectional view of the region of the spinneret.

For this reason, a radiation heater is used below the spinneret, as shown in FIG. 4. In the following this radiation heater is described in like manner for the process of FIGS. 1 and 2. The spinneret 11 is located in a nozzle pack 53. The nozzle pack 53 is accommodated in spin box 10, which is heated. Details are not shown. Arranged below the spinneret and directly adjacent thereto is a radiation heater 56, which is constructed as a ring and made of steel. Its inside surface 58 directed toward the center is formed by a conical surface, which faces the spinneret. A suitable angle of cone (total angle) is, for example, from 30° to 40°. Inserted into the radiation heater is an annular heating strip 57, which may be a resistance heating wire. This resistance heating wire permits to heat the radiation heater to redness at temperatures from above 300° to about 800° C. Very effective temperatures are in a range from 450° to 700° C.

Subjacent the radiation heater is air cooling 51 as has been described above.

It shows now that at the same withdrawal speed of 3000 m/min and with a radiation toward the spinneret by means of the heated element, a substantial increase in the elongation at break will occur and, as a result, likewise an increase in the draw ratio of the yarn. With a radiation from the heater heated to 550° C., it was possible to increase in the example the elongation at break and, thus, the draw ratio by 5%. Thus, a withdrawal speed of 3000 m/min resulted in a takeup speed likewise increased by 5%, namely of 5040 m/min. In the production of the initially indicated yarn denier, this increased takeup speed requires an increase of the melt delivery by discharge pump 9 to 84 g/min. As a result, the productivity of the system can be increased by 5%, by the simple measure of radiating heat toward the spinneret.

Figure 6:
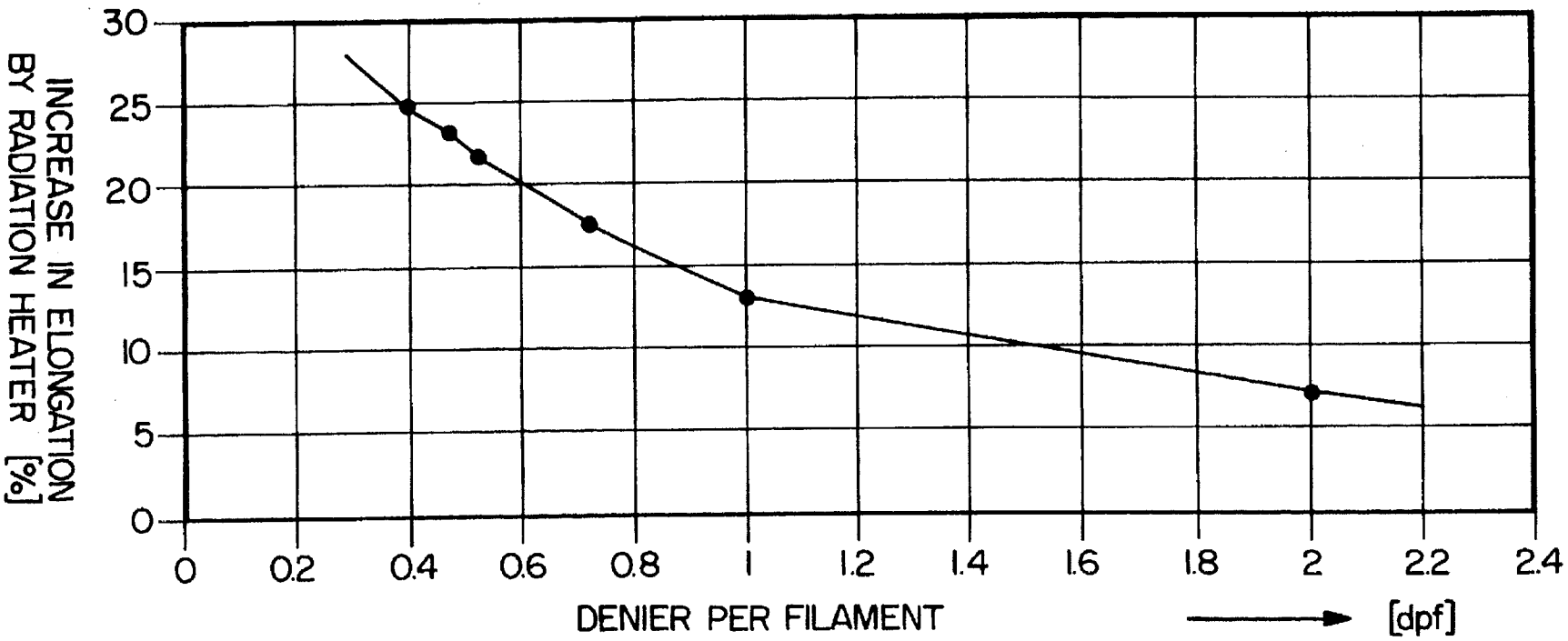
FIG. 6 is a diagram illustrating the dependence of the increase in elongation at break on the total denier of the produced yarn with a predetermined supply of heat to the spinneret.

As shown in the diagram of FIG. 6, the extent of the increased productivity is dependent, on the one hand, on the radiation temperature, and on the other hand on the yarn denier. At higher yarn deniers, the effect is less, or it will be necessary to select a higher radiation temperature. In the individual case, the correlation is to be determined by test.

The procedure in the method shown in FIG. 2 is as follows:

For example, a 55 f 109 textured yarn, namely a yarn having 55 denier and 109 individual filaments is to be produced. This means that each yarn has 0.5 denier per filament (DPF). A draw ratio of 1.6 is determined to be optimal for the draw texturing process. This draw ratio permits a good crimping and a reliable texturing process without filament breakages. This draw ratio means that a partially oriented yarn having a denier of 88 and 109 filaments is to be supplied from feed yarn package 33. To partially orient such a yarn, so as to be able to maintain the draw ratio of 1.6, it will be necessary to adjust a ½ to ⅓ higher elongation at break. At a draw ratio of 1.6, the elongation at break must be 120%. From the diagram of FIG. 5 or the Table, the corresponding withdrawal speed is 2600 m/min, which must be adjusted in a method according to FIG. 2 at draw rolls 16. To produce an 88-denier, partially oriented yarn at 2600 m/min, it is necessary to adjust the flow rate of the melt on the pump to 25.5 g/min for each spinning position. An increase in the flow rate of the melt is not possible, since it will change likewise the withdrawal speed and, thus, the draw ratio. Thus, the draw ratio that is predetermined by the texturer or throwster, limits the productivity of the producer of the partially oriented yarn.

However, it is a different matter, when a radiation heater as shown in FIG. 4 is used. At the same draw ratio, it is possible to achieve an increase in the withdrawal speed by 20%, namely to 3360 m/min, in that heat is radiated toward the spinneret by the heater of FIG. 4 at a temperature of approximately 550° C. The flow rate of the melt is to be increased accordingly to 32.9 m/min. As a result, productivity is increased by more than 20% with an otherwise unchanged machine layout.

Alternatively, a textured yarn of 55 denier and 109 filaments is to be produced, however, without exceeding in the takeup zone the withdrawal speed and the takeup speed of 3000 m/min. The reason for such limitations lies in occasional process problems with sensitive yarns. Such problems may however be caused by the mechanical layout of the takeup machine, whose maximum speed is limited.

Figure 5:
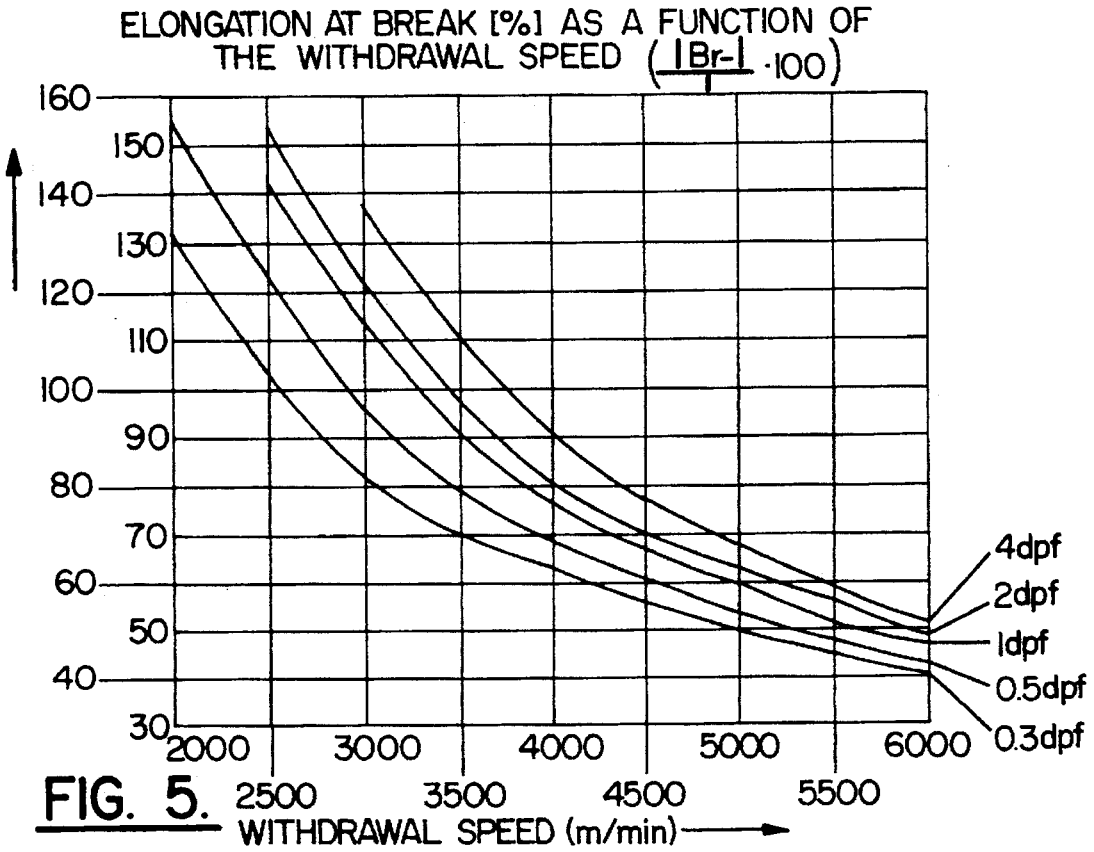
FIG. 5 is a diagram illustrating, in accordance with Table 1, the relationship between withdrawal speed and elongation at break for partially oriented polyester yarns with different filament deniers.

As can be noted from Table 1 or the diagram of FIG. 5, this yarn has an elongation at break of 96%. Therefore, the draw ratio to be selected in the draw zone is about two thirds of the breaking length of 196%. Selected is a draw ratio of 1.3:1. It results therefrom that the denier of the partially oriented yarn, that is supplied as feed yarn in the draw texturing process, must amount to 55 dtex×1.3=71.5 denier. From this, it results again that this yarn is produced in the spin zone at a flow rate of the melt amounting to 71.5 g/9000 m×3000 m/min=23.8 g/min per spinning position.

When a radiation heater of FIG. 4 is now used again, and operated at a temperature of 550° C., a 20% increased elongation at break of 96%×1.2%=115% is obtained at a withdrawal speed of 3000 m/min, namely a breaking length of 215%. Thus, in the subsequent drawing phase, it is possible to adjust the draw ratio at about two thirds of this value, i.e. to 1.45. This again means that to produce a total denier of 55 denier, it is necessary to supply as feed yarn a partially oriented yarn with a denier of 55×1.45=79 denier. To produce a 79 denier yarn at a withdrawal speed of 3000 m/min, it is necessary to adjust the flow rate of the melt to 26.3 g/min per spinning position. As a result, the productivity in the spinning phase can be increased by 26.3–23.8/23.8=10%.

It should be remarked that individual values forming the basis for the preceding calculation and examples were determined for a certain polymer (polyester). As a function of origin and the kind of polymer in use, deviations may result for the individual values, which are to be determined by test. This applies on the one hand to the determined elongations at break, the dependence of the draw ratio on the determined elongation at break, the correlation of elongation at break and denier of individual filaments, the correlation of radiation temperature and increase in the elongation at break, and likewise to the denier-related increase in productivity.

Thus, an important characteristic of the invention is the fact that the melt is heated in the spinneret. To this end, the spinneret is heated in addition to the heat, which it receives from the melt, the surrounding spin pack, and the surrounding spin box. Preferably, the temperature of the spinneret is increased by at least 5° C. and up to 40° C. In tests, increases in the temperature by 8° to 20° C. have shown to be advantageous. The basis to proceed from is always the temperature that results from the melt contacting the spinneret and the heated spin box. Normally, at a relatively low temperature of the spinneret, the heating must accordingly be greater by an additional supply of heat.

Compensated for are not only losses in heat radiation on the underside of the spinneret, but also an additional increase in temperature occurs. Whereas in a conventional process, temperatures of about 290° C. were measured on the underside of the spinneret, a radiation from a radiator heated to 550° C. resulted in an increased temperature of 310° C. The radiation heater has shown to be especially reliable in operation. However, it is also to presume that resistance heating wires may be laid in the spinneret, which permit a corresponding heating of the spinneret. The disadvantages of such a realization, in particular the problems in the manufacture are obvious. On the other hand, the spinneret is easy to clean in this instance. In comparison therewith, the annular radiation heater has the advantage that it prevents on the one hand the spinneret and in particular its underside from being directly exposed to the subjacent air cooling. On the other hand, an adequate air exchange occurs inside the annular radiation heater, so as to remove vapors, in particular monomer and oligomers, and to prevent unacceptable deposits on the underside of the spinneret. For cleaning the underside of the spinneret, the radiation heater is unilaterally arranged on a hinge, so that it can be opened downward.

That which is claimed is:

1. A method of producing a multifilament yarn from a heated thermoplastic melt comprising the steps of extruding the heated melt through a spinneret at a predetermined weight flow rate so as to produce a plurality of advancing filaments, and including applying additional heat to the melt in the spinneret and/or immediately upon its exit from the spinneret, gathering the advancing filaments to form an advancing yarn, withdrawing the advancing yarn from the spinneret at a speed of at least about 2000 m/min so as to at least partially orient the molecules of the yarn, drawing the advancing yarn between two feed rolls so as to impart a predetermined draw ratio, and winding the advancing yarn into a yarn package, wherein the withdrawing step and the drawing step include adapting the withdrawal speed and/or the draw ratio to the changed physical relationship between the withdrawal speed and draw ratio resulting from the amount of heat applied in the step of applying additional heat to the melt, and wherein the extruding step includes adapting the weight flow rate of the melt to the adapted withdrawal speed and/or the adapted draw ratio such that a predetermined total denier is attained.

2. The method as defined in claim 1 wherein the step of applying additional heat to the melt includes heating the spinneret.

3. The method as defined in claim 2 wherein the step of heating the spinneret includes directing infrared radiation to the underside of the spinneret.

4. The method as defined in claim 3 wherein the step of directing infrared radiation to the underside of the spinneret includes positioning an annular metallic member immediately below the spinneret, with the annular metallic member including a conical radiation surface which faces the underside of the spinneret, and heating the annular metallic member.

5. The method as defined in claim 1 wherein the step of applying additional heat to the melt includes directing a stream of heated air or gas transversely across the underside of the spinneret so as to engage the melt immediately upon exiting from the spinneret.

6. The method as defined in claim 5 wherein the step of directing a stream of heated air or gas includes directing the stream so as to have a component directed toward the underside of the spinneret.

7. A method of producing a multifilament yarn from a heated thermoplastic melt comprising the steps of:

extruding the heated melt through a spinneret at a predetermined weight flow rate so as to produce a plurality of advancing filaments, and including applying additional heat to the melt in the spinneret and/or immediately upon its exit from the spinneret, gathering the advancing filaments to form an advancing yarn, withdrawing the advancing yarn from the spinneret at a speed of at least about 2000 m/min so as to at least partially orient the molecules of the yarn, winding the partially oriented yarn into a package, unwinding the partially orientated yarn from the package, drawing the unwound partially oriented yarn by advancing the same between two feed rolls so as to impart a predetermined draw ratio, then winding the yarn into a finished yarn package, wherein the withdrawing step and the drawing step include adapting the withdrawal speed and/or the draw ratio to the changed physical relationship between the withdrawal speed and draw ratio resulting from the amount of heat applied in the step of applying additional heat to the melt, and wherein the extruding step includes adapting the weight flow rate of the melt to the adapted withdrawal speed and/or the adapted draw ratio such that a predetermined total denier is attained.

8. The method as defined in claim 7 wherein the step of applying additional heat to the melt includes heating the spinneret.

9. The method as defined in claim 8 wherein the step of heating the spinneret includes directing infrared radiation to the underside of the spinneret.

10. The method as defined in claim 9 wherein the step of directing infrared radiation to the underside of the spinneret includes positioning an annular metallic member immediately below the spinneret, with the annular metallic member including a conical radiation surface which faces the underside of the spinneret, and heating the annular metallic member.

11. The method as defined in claim 7 wherein the step of applying additional heat to the melt includes directing a stream of heated air or gas transversely across the underside of the spinneret so as to engage the melt immediately upon exiting from the spinneret.

12. The method as defined in claim 11 wherein the step of directing a stream of heated air or gas includes directing the stream so as to have a component directed toward the underside of the spinneret.

13. An apparatus for producing a multifilament yarn comprising:

an extruder for heating and melting a thermoplastic material to form a heated melt, an adjustable feed pump connected to the extruder for delivering the heated melt at an adjustable weight flow rate, a spinneret connected to the output of said feed pump so as to produce a plurality of advancing filaments from the melt, means for applying additional heat to the melt in the spinneret and/or immediately upon exiting from the spinneret, guide means for gathering the advancing filaments to form an advancing yarn, means for withdrawing the advancing yarn from the spinneret at a speed of at least about 2000 m/min so as to at least partially orient the molecules of the yarn, means downstream of the withdrawing means for drawing the advancing yarn so as to impart a predetermined draw ratio to the advancing yarn, and a winder for winding the advancing yarn into a yarn package.

14. The apparatus as defined in claim 13 wherein said means for applying additional heat to the melt comprises an annular metallic member mounted immediately below the spinneret, with the annular metallic member including a conical radiation surface which faces the underside of the spinneret, and means for heating the annular metallic member.

15. The apparatus as defined in claim 14 wherein said spinneret is mounted to a spin box, and said annular metallic member is pivotally mounted to said spin box so as to permit access to the spinneret for cleaning thereof.

16. The apparatus as defined in claim 13 wherein said means for applying additional heat to the melt comprises means for directing a stream of heated air or gag transversely across the underside of the spinneret so as to engage the melt immediately upon exiting from the spinneret.

* * * * *